US006401250B1

(12) United States Patent
McNabb

(10) Patent No.: US 6,401,250 B1
(45) Date of Patent: Jun. 11, 2002

(54) VENTILATED ATHLETIC SUPPORT GARMENT

(76) Inventor: Mark J. McNabb, 6522 Segovia Cir., Huntington Beach, CA (US) 92647

( * ) Notice: Subject to any disclaimer, the term of this patent is extended or adjusted under 35 U.S.C. 154(b) by 0 days.

(21) Appl. No.: 09/771,318

(22) Filed: Jan. 24, 2001

(51) Int. Cl.[7] ..... A41B 9/00
(52) U.S. Cl. ..... 2/78.2; 2/228; 2/69; 2/227
(58) Field of Search ..... 2/227, 228, 79, 2/78.1, 78.2, 400, 403; 450/100–104

(56) References Cited

U.S. PATENT DOCUMENTS 3,392,733 A 7/1968 Blair
3,526,229 A 9/1970 Blair
3,793,646 A 2/1974 Tempelhof
4,009,495 A 3/1977 Faust
4,236,257 A 12/1980 Williams et al.
5,131,100 A 7/1992 Atwater et al.
5,136,727 A 8/1992 Brisco
6,023,789 A 2/2000 Wilson et al.

*Primary Examiner*—Gloria M. Hale
*Assistant Examiner*—Tejash Patel
(74) *Attorney, Agent, or Firm*—Fulwider Patton Lee & Utecht, LLP

(57) ABSTRACT

An athletic garment including an open mesh resilient strip in the crotch and inner leg area incorporated in an elastic form fitting body material cooperating to embrace the buttocks, hips and upper legs of an athlete.

19 Claims, 2 Drawing Sheets

VENTILATED ATHLETIC SUPPORT GARMENT

BACKGROUND OF THE INVENTION

1. Field of the Invention

The present invention relates to a form fitting athletic support garment.

2. Description of the Prior Art

With the popularity of professional and amateur sports and athletic events, considerable attention has been given to the health and fitness of the athlete. Active individuals rely heavily on their legs for maneuverability and speed. Even the most fit athlete can from time to time incur injuries from extension exertion or extreme maneuvers. Injuries often occur in the upper leg, hamstring, quads or groin area of the athlete. Those injuries can often plague the athlete repeatedly, particularly when the athletic schedule does not provide sufficient time for complete healing or recovery.

It has been recognized that support and warmth is important in preventing injury in the first place and in, after an injury has occurred, allowing the athlete to heal. To this end, spandex shorts or liners have gained popularity in both professional leagues and with the weekend athlete. Those shorts are often constructed of a polyurethane block copolymer of elastomeric fibers, such as Lycra® available from Dupont. Such elastomeric products are popular for these applications since they exhibit an amazing capability to stretch, up to six or seven times the original length, and snap back to the starting size with no loss of elasticity. Typically, Lycra® is combined with other fibers, either natural or man made.

It is a characteristic of Lycra® that, in the form fitting athlete shorts construction, the material must be of substantial thickness, often on the order of 14 to 15 ounces per square yard, to provide the necessary support and warmth to support and contain the warmth of the athlete's critical physical structure.

It is a shortcoming of the athletic shorts constructed of such materials that Lycra® has limited through pores thus rendering the material impervious to air and preventing adequate ventilation. It is this characteristic that is advantageous for such material to be utilized as wetsuits for maintaining the warmth and comfort of swimmers, surfers and divers working in cold ocean waters. That characteristic in an athletic short worn for three hours or more on a hot day in a baseball game can, however, detract considerably from the comfort and performance of the athlete.

Thus there has long existed a need for a form fitting athletic garment that will provide meaningful support for the athlete but yet will provide for ventilation, particularly in the crotch area which often experiences considerable heat and is subject to extensive perspiration. To this end, various garments and materials have been proposed. One such garment is in the form of a pair of shorts which includes form fitting legs carried from a pair of ventilation jockey style shorts covering the abdomen and buttock up to the waist. A device of this type is shown in U.S. Pat. No. 5,136,727 to Brisco. Such devices, while satisfactory for some applications, fail to provide the necessary degree of support around the groin area and in the buttocks area thus leaving the athlete open to potential injuries and reoccurring injuries in the groin area.

Consequently, there exists a need for an athletic garment which will provide the desired support for the upper legs, buttocks, and groin while affording ventilation in the crotch area and below for maintaining the desired combination of support and ventilation.

SUMMARY OF THE INVENTION

The athletic garment of the present invention is characterized by a relatively heavy form fitting material about the buttocks, hips and outer legs and having a ventilating mesh in the crotch and inner leg area.

The invention can take many different forms. In one instance, it is in the form of an undergarment to be worn under a baseball player's uniform. One embodiment is in the form of a pair of shorts extending to the mid-thigh area. In other forms, the legs extend downwardly to just above the knee and in other forms they extend entirely to the athlete's ankles.

It is contemplated that the ventilation gusset in the crotch and inner leg area can be in the form of 80% polyester and/or nylon fiber and 5% to 20% spandex, Lycra® or the like. The mesh in some embodiments has from 75 to 125 openings per square inch in the relaxed state and 40 to 60 openings per square inch in the stretched state.

In some embodiments, the form fitting body material is constructed of a knitted or woven microfiber polyester. It can be a blend of knitted polyester designed to wick moisture away from the body to the exterior surface of the garment. It can be on the order of 80% to 93% polyester and the remainder spandex. In some form, the body material is constructed of 100% woven microfiber polyester.

DESCRIPTION OF THE PREFERRED EMBODIMENT

Figure 2:
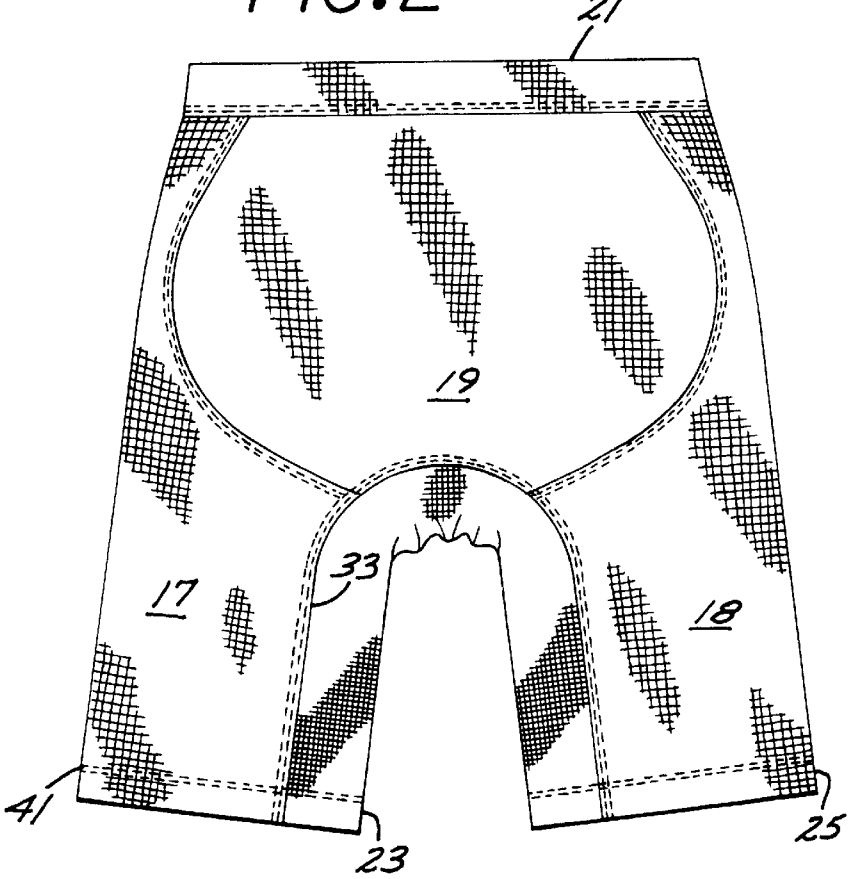
FIG. 2 is a rear view of the garment shown in FIG. 1.
Figure 1:
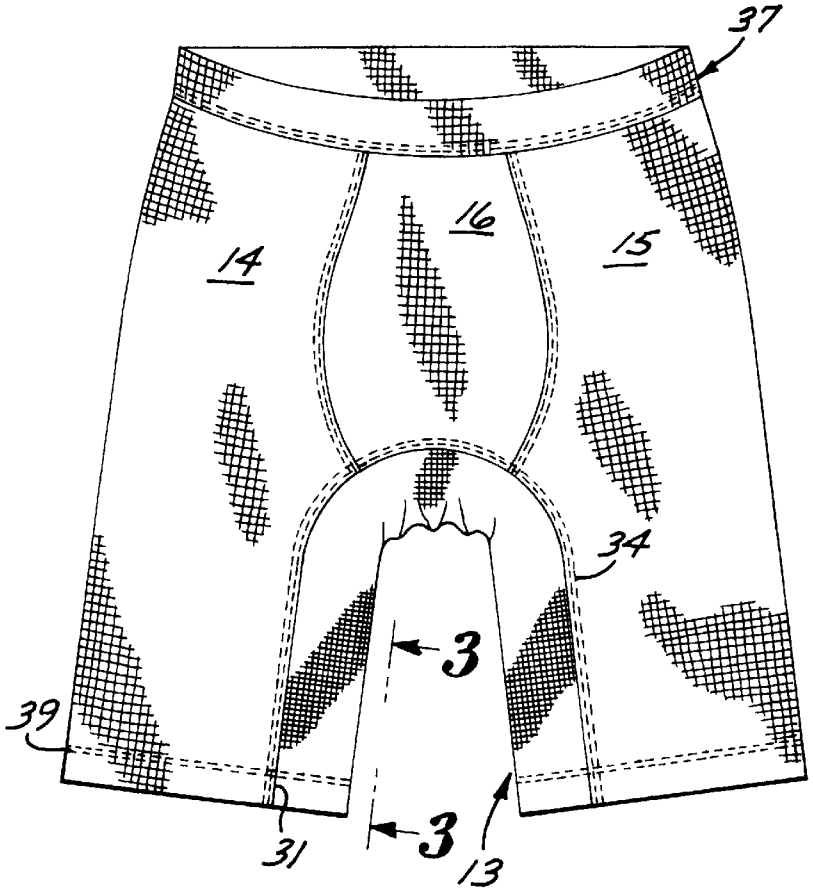
FIG. 1 is a front view of a form fitting ventilated athletic support garment embodying the present invention.
Figure 4:
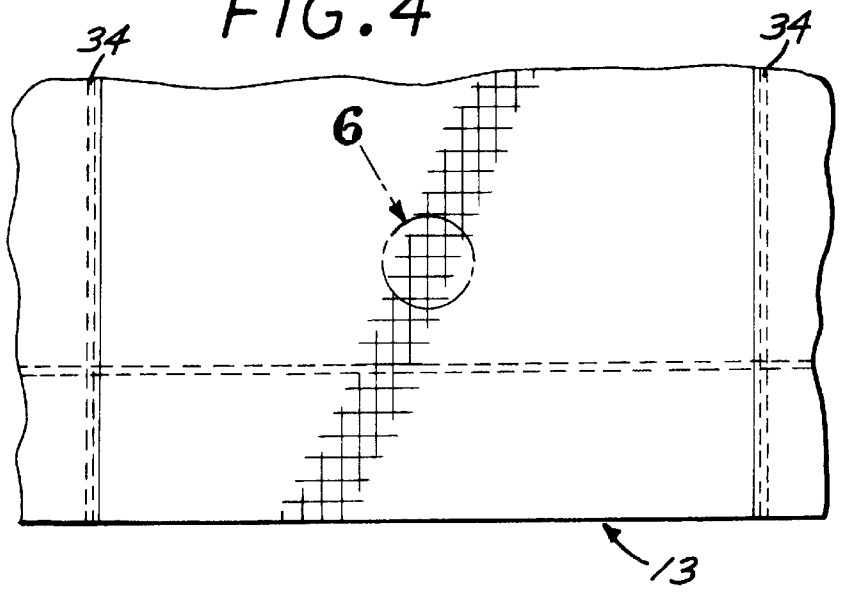
FIG. 4 is a view similar to FIG. 3 but with the gusset stretched.
Figure 6:
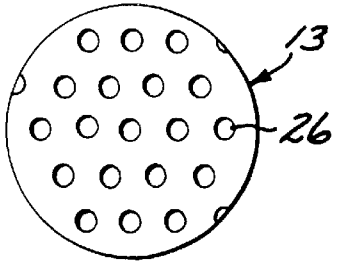
FIG. 6 is a view taken from the circle designated 6 in FIG. 4 but enlarged.
Figure 3:
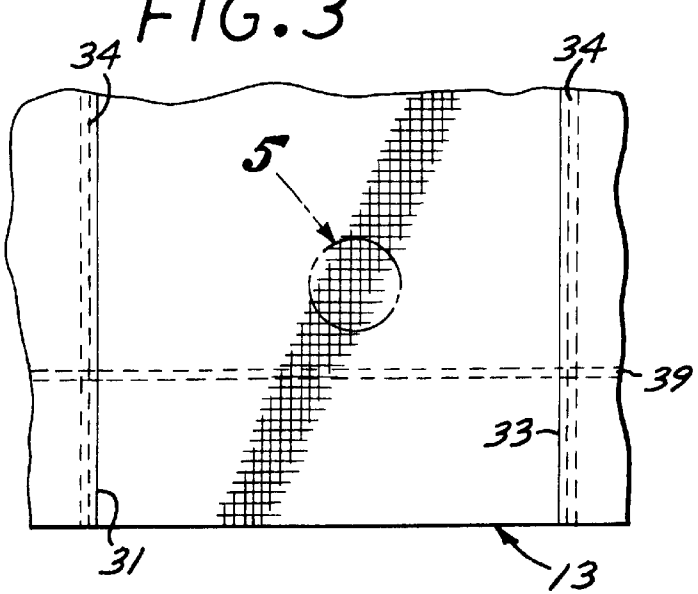
FIG. 3 is a view taken along the line 3—3 in FIG. 1 but enlarged in scale.
Figure 5:
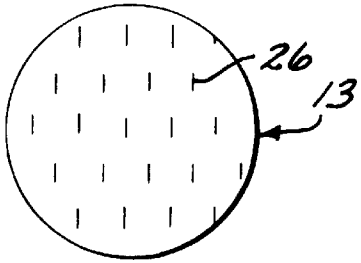
FIG. 5 is a view taken from the circle designated 5 in FIG. 3 but enlarged.

The athletic garment of the present invention is intended to provide support in the upper leg, hip, buttocks and groin areas of an athlete by providing a stretchable form fitting construction affording both support and thermally insulative qualities. Materials commonly used for those purposes include woven elastomeric fibers known in some areas as spandex and in others as elastane. These fibers woven into Lycra® are available from Dupont and have been found to provide the highly desirable supportive form fitting construction important to affording support against injury and reinjury of the various vulnerable muscles in the groin area, in the area of the upper hamstring. Form fitting material having a thickness on the order of 9 to 10 ounces per square yard or more has been found to afford protection to the exposed hip and thigh of the athlete against high impact contact which might impart bruises and contusions to the hip, thigh or the like. The form fitting material on that order of thickness, however, typically has minimal or no breathing capability, thus leaving the active athlete with a build up of heat within the confines of the form fitting material, all compounded by the combination of high moisture and high temperatures associated with perspiration and excessive exertion of energy.

Efforts have been made in other arts to ventilate various garments. Examples of such work in other arts include the proposal that work trousers be modified to incorporate a ventilation gusset in the crotch area. Such a device is shown in U.S. Pat. No. 3,793,646 to Tempelhof. Such trousers, while offering some aeration of the workman's crotch area, fails to provide form fitting support of the type which is required by active athletes to avoid injury and minimize the risk of reinjury.

Running shorts have been proposed including a body of form fitting material with bands of ventilation mesh down the opposite sides thereof. Such shorts do nothing to afford ventilation in the interior thigh area.

In other areas of the art, workers have turned their attention to the need for ventilation. As a further example, it has been proposed to ventilate the crotch area of a woman's undergarment. Ventilated panties are disclosed in U.S. Pat. No. 4,236,257 assigned to International Playtex, Inc. While serving to provide for some degree of comfort and flexibility, such garments also fail to provide form fitting support for an athlete's muscular structure.

The instant invention provides a solution to all the foregoing shortcomings by providing a mesh gusset in the crotch area, extending down the interior of the legs of an athlete, incorporated in a garment having form fitting elastic material covering the buttocks, hips and exterior portion of the legs of the athlete to cooperate in forming a pair of shorts or pants for use by the athlete in active athletic activity. The garment can be embodied in undergarments such as shorts for a baseball player, outer wear such as cycling shorts, pants, rock climbing shorts or pants, snowboard pants, motorcross pants, physical fitness shorts or pants and surf or volley ball shorts or any other high performance athletic garment.

An exemplary embodiment of the present invention includes, generally, a gusset 13 lining the crotch and inner leg area and a form fitting body material of Lycra® or other similar stretch material covering the buttocks, hips and outer legs of the athlete to form the front leg and center panels 14, 15 and 16 and back leg and seat panels 17, 18 and 19 to define a top waist 21 and leg tubes 23 and 25.

Elastomeric fibers have been recognized to, when combined with other fibers in a woven or knitted material, such as polyester or nylon, to stretch up to six or seven times its original length and snap back to the initial state, thus affording great comfort and freedom of movement for an athletic garment. This material is available under the trademark LYCRA® with as little as 2% spandex, combined with polyester or nylon fibers. The example of the garment of the present invention presented herein is in the form of a pair of undershorts to provide support and comfort for, for instance, a baseball player.

The stretch material for the body of the shorts of my invention has been selected to cooperate with the mesh gusset 13 in providing the desired support, warmth and freedom of movement for highly active athletic. I have found that Lycra®, being constructed of a combination of spandex and polyester fiber, provides the desired degree of support and flexibility. In some instances, for more of a conventional underwear feel, medium knit or woven stretch cotton is substituted for the polyester fiber. In other instances, stretch woven or knit nylon is selected. In any event, in the preferred embodiment, the body material selected is constituted of between 7% and 20% Lycra® with the remainder being polyester, nylon or cotton. In practice, any similar combination which provides the desired degree of support and expansive movement is acceptable. In the specific embodiment shown, spandex makes up 7% of the construction and the remaining 93% is polyester fiber.

In practice, I have constructed the body material to be formed with confronting edges 31 and 33 spaced apart about three inches in the crotch and inner thigh area to provide an opening for receipt of the mesh material 13. I have discovered for an adult athlete a spacing of about two to three inches is satisfactory. Overall, I have determined that a spacing of two to five inches provides a sufficient opening for the unstretched ventilation gusset 13.

The gusset 13 itself is constructed of an open mesh and, in the preferred embodiment, is constructed with the mesh having a weight of about four to six ounces per square yard. The mesh is constructed of a knitted polyester or nylon fiber and spandex. The mesh may be constructed of between 80% and 95% polyester or nylon and between 5% and 20% spandex. The mesh is formed with between 75 and 125 openings 26 per square inch in the relaxed state and 40 to 60 openings per inch when stretched. The mesh may have between about 55 and 75 threads per square inch and in the preferred embodiment has 64 weaves per square inch. One material found to be satisfactory is style No. ZD 2613 or ZD 2645 available from Darlington Mills.

The opposite edges of the mesh are affixed to the edges 31 and 33 of the body material by stitching 34 or any other desired manner.

The athletic garment of the present invention has been worn and tested by professional athletes and has proven to provide exceptional support and comfort for such sports as baseball and football. Various embodiments can be used for casual sports and exercise, including track, bicycling and dance. For the construction shown in the preferred embodiment, the garment is particularly adapted for use as an undergarment and the body material is selected as having a weight of 10 ounces per square yard for maximum flexibility while providing sufficient thermal insulation, support and cushioning of the athlete's muscles against impact.

The body material is configured with a large opening waist 21 circumscribed by a wide elastic waist band, generally designated 37, at least one inch wide and preferably about 1-½ inches in width, to provide robust retention at the top of the hips to cooperate with the overall construction in affording the desired positioning and support. Such band stretches about 50% of its length and with a 25% stretch provides a tension force of about 0.5 pounds. The lower terminus of the respective leg tubes 23 and 25 include respective stitching 39 and 41.

It will be appreciated to those skilled in the art that the athletic garment of the present invention may be worn under the uniform of, for instance, a major league baseball player. As such, the form fitting body material affords support, warmth and cushioning in the buttock, hip, thigh and hamstring area. The mesh 13 provides for tensioning in the crotch and interior leg area to cooperate with the material in the legs 23 and 25 and remaining body material to maintain a close fit on the contour of the athlete's muscular structure and yet provides for expansion and flexibility as the athlete moves through the various exercises demanded by the sport, such as stretching in preparation for taking the batting cage or batter's box and allows for the batter to stride into the swing and rotate and flex as the swing of the bat is carried through the full revolution thereof. Then, as the athlete exercises, runs and moves about the field of play, heat will be built up within the confines of the body material and perspiration generated through the skin of the athlete will be maintained under the body material. In the meantime, each movement, exercise and stroke will tend to pump air through the openings 26 from the gusset 13 to maintain an air exchange in the crotch and inner leg area to thus provide for efficient heat exchange induced by the thermal and moisture absorption rate of the pumped air. This will then tend to maintain the comfort of the athlete while affording support to the vulnerable groin area muscles, hamstrings, thigh muscles and the like.

It will be appreciated from the foregoing that the athletic garment of the present invention provides an efficient and convenient mechanism for affording support and comfort for an athlete.

What is claimed:

1. A ventilated athletic support garment to be worn by an athlete, comprising:

a thick stretch form fitting body material forming a pant body to stretch about and support the buttocks, hips and upper outer legs of the athlete and configured in the crotch area and inner thigh areas with edges spaced apart to form a vent opening;

an elongated gusset in the opening, affixed to the body and constructed of a relatively thin stretchable mesh material formed with 5 to 20% spandex and 80 to 95% polyester or nylon and, in the relaxed condition including between 75 and 125 ventilation openings per square inch spaced throughout for flow of air and cooperating with such body to form tubular leg sections to support such hips and legs and to provide ventilation to the athlete's crotch and inner leg area.

2. The ventilated athletic support garment as set forth in claim 1 wherein:

said mesh is constructed of polyester and spandex fiber.

3. The ventilated athletic support garment as set forth in claim 1 wherein:

said mesh is woven.

4. The ventilated athletic support garment as set forth in claim 1 wherein:

said mesh is constructed of nylon and spandex fiber.

5. The ventilated athletic support garment as set forth in claim 1 wherein:

the pant body is formed with a vent opening having a width of from two to five inches; and the gusset fills the entire width of the open strip.

6. The ventilated athletic support garment as set forth in claim 1 wherein:

the mesh is knitted.

7. The ventilated athletic support garment as set forth in claim 1 wherein:

the mesh is formed, in the tensioned condition, with such openings spaced thereabout at between 40 and 60 such openings per square inch.

8. The ventilated athletic support garment as set forth in claim 1 wherein:

the mesh is formed with 64 threads per square inch.

9. The ventilated athletic support garment as set forth in claim 1 wherein:

the mesh is formed with between 55 and 75 threads per square inch.

10. The ventilated athletic support garment as set forth in claim 1 wherein:

the body material weighs 10 to 12 ounces per square yard.

11. The ventilated athletic support garment as set forth in claim 1 wherein:

the mesh weighs 4 to 6 ounces per square yard.

12. The ventilated athletic support garment as set forth in claim 1 wherein:

the body material is 80% to 93% cotton.

13. The ventilated athletic support garment as set forth in claim 1 that includes:

a waist band at least one inch wide to closely hug the top of the hips of the wearer and cooperate with the body material to hold such garment tight on the wearer's profile.

14. The ventilated athletic support garment as set forth in claim 1 wherein:

the body material is formed with such edges spaced about three inches apart to define such opening and such gusset fills the entire opening.

15. A ventilated athletic support garment comprising:

a thick woven or knitted stretch form fitting body material forming a pant body to stretch about and support the buttocks, hip and upper/outer legs of the athlete and configured in the crotch area and inner thigh areas with edges spaced apart to form a vent opening;

an elongated gusset in the opening, affixed to the body and constructed of relatively thin stretchable mesh material of no more than 20% spandex and having, in its stretched condition, at least 40 ventilation openings per square inch, said mesh cooperating with said body to form tubular leg sections to cooperate in support and accommodate flexure and movement of the athlete while providing for ventilation in the inner thigh and crotch area through such ventilation openings.

16. The ventilated athletic support garment as set forth in claim 15 wherein:

said mesh includes at least spandex.

17. The vented athletic support garment as set forth in claims 15:

said mesh weights substantially 10 ounces per square yard.

18. A ventilated athletic garment comprising:

a thick stretch form fitting body material forming a pant body to stretch about and support the buttocks, hips and outer legs of the athlete and configured in the crotch area and inner thigh areas with edges spaced apart to form a vent opening; and an elongated gusset in such vent opening constructed of spandex material and constructed of interwoven or knitted threads and further formed with ventilation openings in the weaving or knitting and having a population of at least 40 per square inch in the stretched condition of such mesh.

19. A ventilated athletic support garment comprising:

a form fitting stretch body material forming a pant body to stretch about and support the buttocks, hips and upper legs of an athlete and configured in the crotch and inner thigh areas with edges spaced apart to form a vent opening;

an elongated gusset in the vent opening affixed to the body and constructed of stretchable mesh material including means forming ventilation openings having a relaxed state formed with at least 75 ventilation openings per square inch.

* * * * *